United States Patent [19]

Hasegawa et al.

[11] Patent Number: 4,526,153

[45] Date of Patent: Jul. 2, 1985

[54] AIR-FUEL RATIO CONTROL METHOD FOR AN INTERNAL COMBUSTION ENGINE FOR VEHICLES IN LOW LOAD OPERATING REGIONS

[75] Inventors: Shumpei Hasegawa, Niiza; Osamu Gotoh, Higashikurume; Yutaka Otobe, Shiki, all of Japan

[73] Assignee: Honda Giken Kogyo Kabushiki Kaisha, Tokyo, Japan

[21] Appl. No.: 506,671

[22] Filed: Jun. 22, 1983

[30] Foreign Application Priority Data

Jun. 25, 1982 [JP] Japan ..... 57-109197

[51] Int. Cl.[3] ..... F02M 51/00

[52] U.S. Cl. ..... 123/480; 123/489; 123/491; 123/492

[58] Field of Search ..... 123/478, 480, 489, 492, 123/493, 440, 491

[56] References Cited

U.S. PATENT DOCUMENTS

| | | | |
|---|---|---|---|
| 4,319,327 | 3/1982 | Higashiyama et al. | 123/480 |
| 4,391,251 | 7/1983 | Planteline et al. | 123/440 |
| 4,434,768 | 3/1984 | Ninomiya | 123/489 |
| 4,445,483 | 5/1984 | Hasegawa | 123/480 |

FOREIGN PATENT DOCUMENTS 0062583 10/1982 European Pat. Off. .

*Primary Examiner*—Parshotam S. Lall
*Attorney, Agent, or Firm*—Lyon & Lyon

[57] ABSTRACT

A method for electronically controlling the air/fuel ratio of a mixture being supplied to an internal combustion engine for use in a vehicle, in response to operating conditions of the engine. A plurality of different operating regions of the engine are set beforehand, which are each defined by predetermined values of first and second parameters indicative of operating conditions of the engine. Detection is made of values of the above first and second parameters and the speed of the vehicle. At least one mixture-leaning operating region is selected from the above different predetermined operating regions, in dependence on a detected value of the vehicle speed. When it is determined from detected values of the first and second parameters that the engine is operating in the at least one mixture-leaning operating region selected, leaning of the mixture being supplied to the engine is effected. Preferably, the total range of the above at least one mixture-leaning operating region selected when the detected value of the vehicle speed is lower than a predetermined value is smaller than that selected when the detected value of the vehicle speed is higher than the same predetermined value. Further preferably, while the engine is operating in one of the at least one mixture-leaning operating region which is selected only when the detected value of the vehicle speed is higher than the above predetermined value, leaning of the mixture is effected to an extent different from that effected while the engine is operating in the other mixture-leaning operating region or regions.

12 Claims, 6 Drawing Figures

$V \leqq V_{LS}, T_W \geqq T_{WLS}$

WITH VEHICLE SPEED SW. OFF $T_W < T_{WLS}$ $V > V_{LS}, T_W \geqq T_{WLS}$

WITH VEHICLE SPEED SW. ON

AIR-FUEL RATIO CONTROL METHOD FOR AN INTERNAL COMBUSTION ENGINE FOR VEHICLES IN LOW LOAD OPERATING REGIONS

BACKGROUND OF THE INVENTION

This invention relates to a method for controlling the air-fuel ratio of a mixture being supplied to an internal combustion engine, and more particularly to a method of this kind, which is adapted to effect leaning of the mixture when the engine is operating in a low load region, while maintaining optimal operating characteristics of the engine such as driveability, emission characteristics, and fuel consumption.

A fuel supply control system adapted for use with an internal combustion engine for vehicles, particularly a gasoline engine has been proposed e.g. by Japanese Patent Provisional Publication (Kokai) No. 57-137633, which is adapted to determine the valve opening period of a fuel injection device for control of the fuel injection quantity, i.e. the air-fuel ratio of an air-fuel mixture being supplied to the engine, by first determining a basic value of the valve opening period as a function of engine rpm and intake pipe absolute pressure and then adding to and/or multiplying same by constants and/or coefficients being functions of engine rpm, intake pipe absolute pressure, engine cooling water temperature, throttle valve opening, exhaust gas ingredient concentration (oxygen concentration), etc., by electronic computing means.

On the other hand, it has also conventionally been carried out to lean an air-fuel mixture being supplied to the engine so as to make the air-fuel ratio of the mixture leaner than a theoretical mixture ratio, to thereby enhance the combustion efficiency of the engine and accordingly save the fuel consumption.

However, there are the following problems in carrying out such leaning of the mixture: First, a three-way catalyst, which is conventionally employed to purify ingredients HC, CO, NOx in exhaust gases emitted from the engine, shows a maximum conversion efficiciency of such ingredients when the air-fuel ratio of the mixture has a value equal to a theoretical mixture ratio. Therefore, in an engine having such a three-way catalyst arranged in the exhaust pipe, it is generally employed to control the air-fuel ratio of the mixture to the theoretical mixture ratio in a feedback manner responsive to the output of an $O_2$ sensor arranged in the exhaust system of the engine. However, if this feedback control based upon the output of the exhaust gas sensor is carried out when the engine is operating in a mixture-leaning operating region where the air/fuel ratio of the mixture is controlled to a value leaner from the theoretical mixture ratio, the conversion efficiency of the three-way catalyst drops. Further, if such mixture-leaning operation is carried out in an operating region of the engine where the nitrogen oxides NOx are produced in large amounts, it can result in spoilage of the emission characteristics. Furthermore, leaning of the mixture causes a drop in the engine output, which is disadvantageous when the engine is operating in an operating condition requiring large output torque, such as at sudden acceleration and wide-open-throttle operation, wherein leaning of the mixture will cause degradation of the driveability.

In order to avoid the possibility of spoilage of the emission characteristics and driveability of the engine caused by leaning of the mixture which is intended to curtail the fuel consumption, it has been proposed by Japanese Patent Provisional Publication (Kokai) No. 54-1724 to operate an air-fuel ratio control system in closed loop mode to carry out feedback control of the air-fuel ratio of the mixture so as to achieve a theoretical mixture ratio when the engine rotation speed as assumed to correspond to the vehicle speed is within a predetermined range, while operating the same system in open loop mode to set the air-fuel mixture to a value leaner than the theoretical mixture ratio when the engine rotational speed is outside the above predetermined range.

However, since this proposed method relies only upon either vehicle speed or the engine rotational speed for selecting the closed loop mode control or the open loop mode control to control the air-fuel ratio, it will be impossible to achieve all satisfactory operating characteristics of the engine including fuel consumption, emission characteristics and driveability at the same time.

The operating conditions of an internal combustion engine can be divided in a plurality of different operating regions defined by values of engine operation parameters such as engine rotational speed and intake pipe pressure, and it is therefore necessary to control the air-fuel ratio of the mixture to respective different suitable values in such different operating regions. Furthermore, the range of such different operating regions in which leaning of the mixture can be effected has to be varied depending upon the vehicle speed and the engine temperature.

SUMMARY OF THE INVENTION

It is the object of the invention to provide an air-fuel ratio control method for an internal combustion engine for vehicles, which is capable of accurately discriminating operating regions of the engine wherein leaning of the mixture is required, in dependence on operating conditions of the engine, so as to achieve curtailment of the fuel consumption without spoiling the driveability and emission characteristics of the engine.

According to the invention, there is provided a method for electronically controlling the air-fuel ratio of an air-fuel mixture being supplied to an internal combustion engine for use in a vehicle, in response to operating conditions of the engine, the method being characterized by comprising the following steps: (1) setting beforehand a plurality of different operating regions of the engine, each defined by predetermined values of first and second parameters indicative of operating conditions of the engine; (2) detecting values of the above first and second parameters; (3) detecting the speed of the vehicle; (4) selecting at least one of said plurality of different operating regions as a mixture-leaning region wherein leaning of said mixture is required to control the air-fuel ratio of said mixture to a value leaner than a theoretical mixture ratio, in dependence on a value of the speed of the vehicle detected in the step (3); (5) determining whether or not the engine is operating in the at least one operating region selected in the step (4), from values of the above first and second parameters detected in the step (2); and (6) effecting the above leaning of the mixture when it is determined in the step (5) that the engine is operating in the selected at least one operating region.

Preferably, the total range of the above at least one operating region selected when the detected value of the vehicle speed is lower than a predetermined value is smaller than that selected when the detected value of the vehicle speed is higher than the same predetermined value. Further preferably, while the engine is operating in a particular mixture-leaning region which is selected only when the detected value of the vehicle speed is higher than the above predetermined value, leaning of the mixture being supplied to the engine is effected to an extent different from one effected while the engine is operating in the other mixture-leaning region or regions.

Also preferably, the above first parameter comprises the rotational speed of the engine, and the second parameter the intake passage absolute pressure, respectively.

The method according to the invention further includes the steps of comparing a detected value of the rotational speed of the engine as the first parameter with a predetermined value, selecting part of the above plurality of different operating regions as at least one mixture-leaning operating region, when a detected value of the rotational speed of the engine is higher than the above predetermined value, determining whether or the engine is operating in the above at least one mixture-leaning operating region, from detected values of the rotational speed of the engine and the intake passage absolute pressure, and effecting leaning of the mixture when it is determined that the engine is operating in the above at least one mixture-leaning operating region.

Further preferably, the method according to the invention further includes the steps of detecting the temperature of the engine, selecting part of the above plurality of different operating regions as at least one mixture-leaning operating region when the temperature of the engine is lower than a predetermined value, determining whether or not the engine is operating in the last-mentioned at least one mixture-leaning operating region, from detected values of the above first and second parameters, and effecting leaning of the mixture when it is determined that the engine is operating in the last-mentioned at least one mixture-leaning operating region.

The above and other objects, features and advantages of the invention will become more apparent from the ensuing detailed description taken in conjunction with the accompanying drawings.

DETAILED DESCRIPTION

The method according to the invention will now be described in detail with reference to the drawings.

Figure 1:
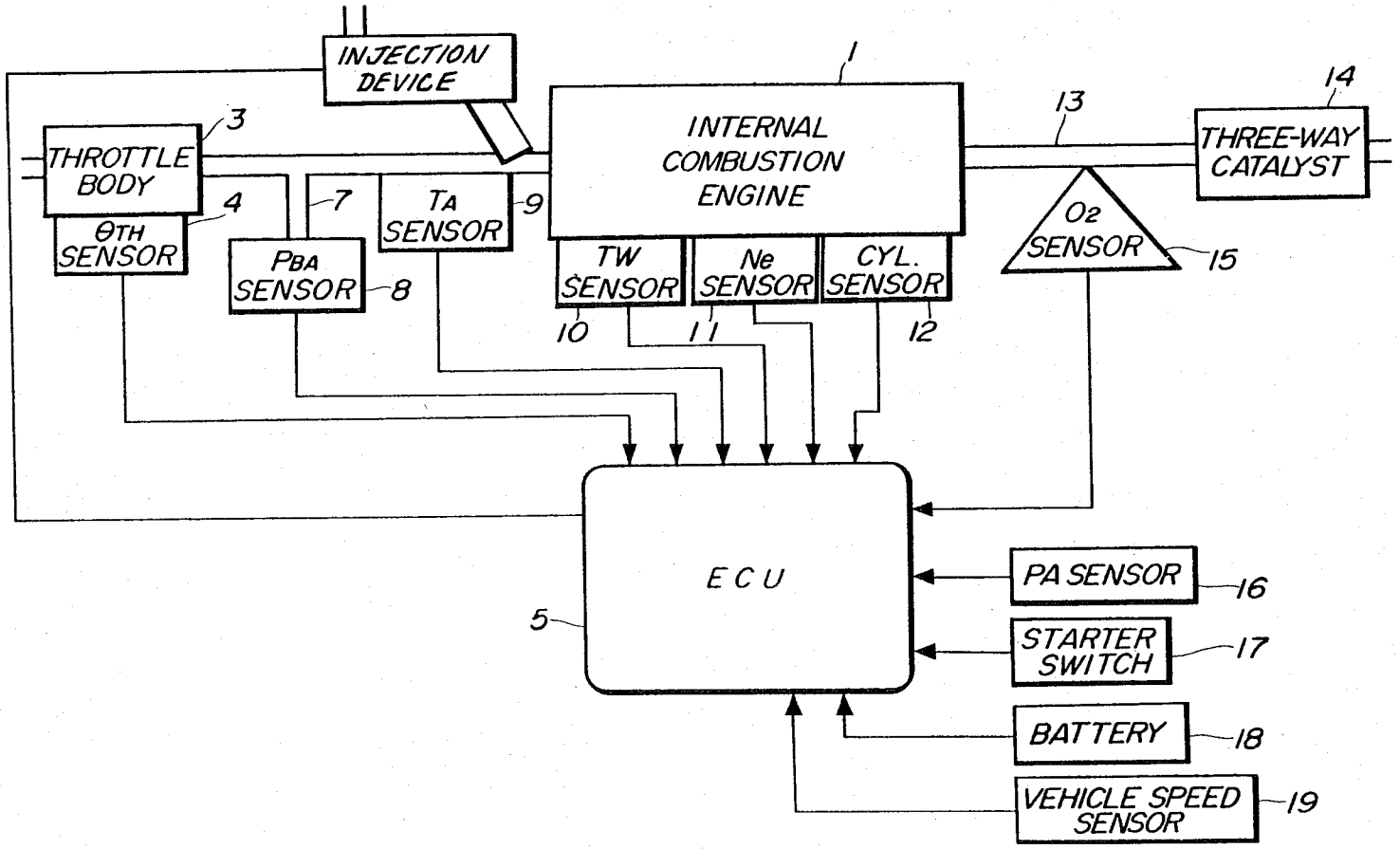
FIG. 1 is a block diagram illustrating, by way of example, the whole arrangement of a fuel supply control system to which is applied the method according to the invention.

Referring first to FIG. 1, there is illustrated the whole arrangement of a fuel supply control system for internal combustion engines, to which the method according to the invention is applicable. Reference numeral 1 designates an internal combustion engine which may be a four-cylinder type, for instance. An intake pipe 2 is connected to the engine 1, in which is arranged a throttle valve 3, which in turn is coupled to a throttle valve opening ($\theta$TH) sensor 4 for detecting its valve opening and converting same into an electrical signal which is supplied to an electronic control unit (hereinafter called "ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure (PBA) sensor 8 communicates through a conduit 7 with the interior of the intake pipe at a location immediately downstream of the throttle valve 3. The absolute pressure (PBA) sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure (PBA) sensor 8 and also electrically connected to the ECU 5 for supplying same with an electrical signal indicative of detected intake air temperature.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational speed sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA), a starter switch 17 for actuating the engine starter, not shown, of the engine 1, and a battery 18 as a power source, respectively, for supplying the ECU 5 with an electrical signal indicative of detected atmospheric pressure, an electrical signal indicative of the on-off positions of the starter switch, and a supply voltage.

Further connected to the ECU 5 is a vehicle speed sensor 19 which is formed by a vehicle speed switch, for supplying the ECU 5 with a signal indicative of the speed of a vehicle, not shown, in which the engine is installed.

The ECU 5 operates in response to various engine operation parameter signals stated above, to determine operating conditions of the engine including mixture-leaning operating regions, and calculate the fuel injection period of the fuel injection valves 6 by the use of an equation given below, in accordance with the determined operating conditions of the engine, and supplies corresponding driving signals to the fuel injection valves 6.

$$TOUT = (Ti - TDEC) \times (KTA \times KTW \times KAFC \times KPA \times KWOT \times KO_2 \times KLS) + TACC \times (KTA \times KTWT \times KAFC) + TV \quad (1)$$

where Ti represents a basic value of the valve opening period for the fuel injection valves 6, which is determined from the engine rotational speed Ne and the intake pipe absolute pressure PBA, and TDEC and TACC represent correction values applicable, respectively, at engine deceleration and at engine acceleration. KTA denotes an intake air temperature-dependent correction coefficient, KTW a fuel increasing coefficient, KAFC a fuel increasing coefficient applicable after fuel cut operation, KPA an atmospheric pressure-dependent correction coefficient, and KWOT a coefficient for enriching the air/fuel mixture, which is applicable at wide-open-throttle, respectively. $KO_2$ represents an "oxygen concentration-responsive feedback control" correction coefficient which has a value variable in response to actual oxygen concentration in the exhaust gases, and KLS a mixture-leaning coefficient. The value of the correction coefficient KLS is set to two different values XLS1 and XLS2, depending upon the kinds of mixture-leaning operating regions to be applied, as hereinafter explained.

The ECU 5 supplies driving signals to the fuel injection valves 6 to open same with a duty factor corresponding to a value of the fuel injection period TOUT calculated as above.

Figure 2:
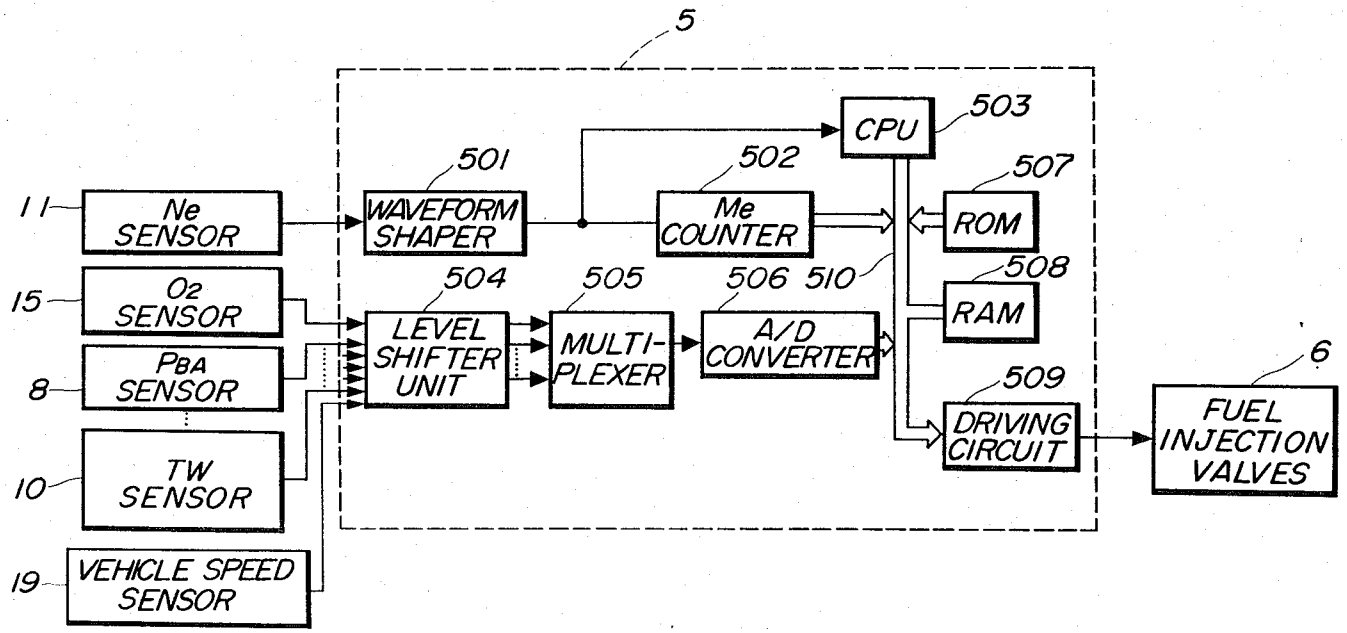
FIG. 2 is a block diagram illustrating, by way of example, the internal arrangement of the electronic control unit (ECU) in FIG. 1.

FIG. 2 shows a circuit configuration within the ECU 5 in FIG. 1. An output signal from the Ne sensor 11 is applied to a waveform shaper 501, wherein it has its pulse waveform shaped, and supplied to a central processing unit (herein-after called "CPU") 503, as the TDC signal, as well as to an Me value counter 502. The Me value counter 502 counts the interval of time between a preceding pulse of the TDC signal and a present pulse of the same signal, inputted thereto from the Ne sensor 11, and therefore its counted value Me corresponds to the reciprocal of the actual engine rpm Ne. The Me value counter 502 supplies the counted value Me to the CPU 503 via a data bus 510.

The respective output signals from the intake pipe absolute pressure (PBA) sensor 8, the engine water temperature sensor 10, the $O_2$ sensor 15, the vehicle speed sensor 19, etc. have their voltage levels successively shifted to a predetermined voltage level by a level shifter unit 504 and applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "ROM") 507, a random access memory (hereinafter called "RAM") 508 and a driving circuit 509. The RAM 508 temporarily stores various calculated values from the CPU 503, while the ROM 507 stores control program executed within the CPU 503 as well as maps of a basic fuel injection period Ti for fuel injection valves 6 and predetermined values of correction coefficients, etc. The CPU 503 executes the control program stored in the ROM 507 to calculate the fuel injection period TOUT for the fuel injection valves 6 in response to the various engine operation parameter signals, and supplies the calculated value of fuel injection period to the driving circuit 509 through the data bus 510. The driving circuit 509 supplies driving signals corresponding to the above calculated TOUT value to the fuel injection valves 6 to drive same.

Figure 4:
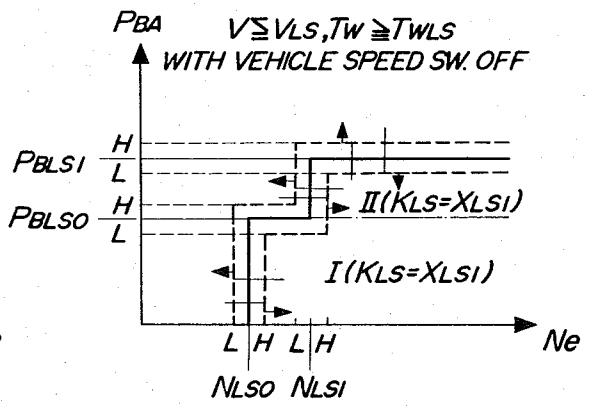
FIG. 4 is a graph showing mixture-leaning operating regions of the engine which are set when the vehicle speed V is equal to or lower than a predetermined value VLS.
Figure 3:
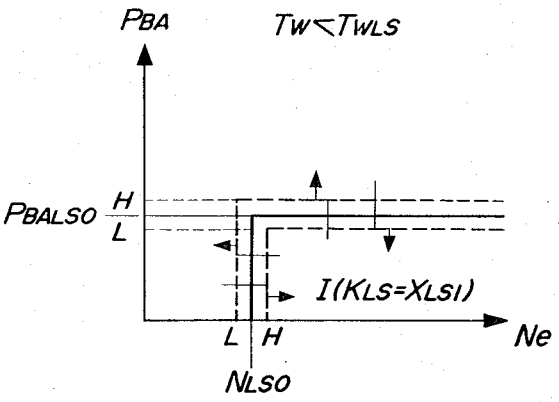
FIG. 3 is a graph showing a mixture-leaning operating region of the engine which is set when the engine temperature TW is lower than a predetermined value TWLS.
Figure 5:
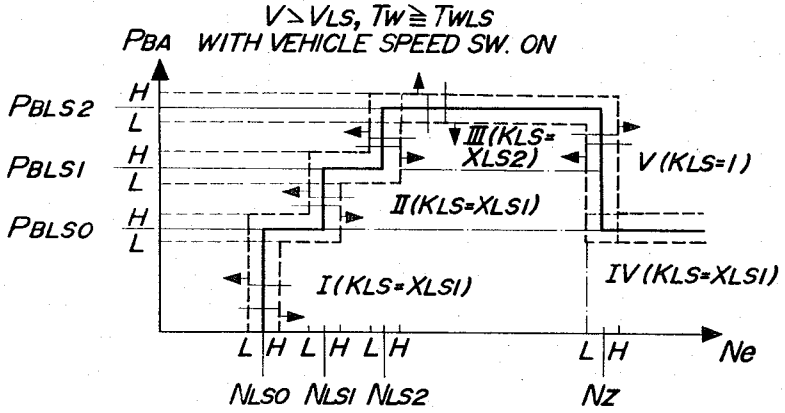
FIG. 5 is a graph showing mixture-leaning operating regions of the engine which are set when the vehicle speed V higher than the predetermined value VLS, as well as a mixture-leaning operating region which is set when the engine rotational speed Ne is higher than a predetermined value NZ.

FIGS. 3 through 5 show graphs plotting mixture-leaning operating regions according to an embodiment of the invention. According to the method of the invention, an operating region where the aforementioned mixture-leaning operating coefficient KLS is to be applied is composed of a plurality of subdivided regions each defined by predetermined values of the engine rotational speed Ne and the intake pipe absolute pressure PBA, and which of the above subdivided regions leaning of the mixture should actually be carried out is determined, depending upon the speed V of the vehicle in which the engine is installed, and the temperature of the engine, for instance the engine cooling water temperature TW. Further, the value of the mixture-leaning coefficient KLS is set to different values depending upon the kinds of the subdivided regions actually applied, for instance XLS1 and XLS2.

In the mixture-leaning operating region, i.e. the subdivided regions, the air-fuel ratio control is effected in open loop mode, wherein the value of the oxygen concentration-responsive feedback control correction coefficient $KO_2$, applied to the aforementioned equation (1), is set to 1, while the basic value Ti of the valve opening period is corrected by other correction coefficients such as the mixture-leaning coefficient KLS, to control the valve opening period for the fuel injection valves 6. On the other hand, in the feedback control operating region of the engine, the air-fuel ratio control is effected in closed loop mode, wherein the value of the correction coefficient KLS is set to 1, while simultaneously the air-fuel ratio of the mixture or the valve opening period is controlled to a theoretical mixture ratio in a feedback manner responsive to the value of the correction coefficient $KO_2$ which is varied in response to changes in the output from the $O_2$ sensor 15.

According to the illustrated embodiment of the invention, the mixture-leaning operating region of the engine comprises first to fourth subdivided regions as shown in FIGS. 3–5. The first region I is defined as a region wherein the engine rotational speed Ne is higher than a first predetermined value NLS0 (e.g. 950 rpm) and the intake pipe absolute pressure PBA is lower than a first predetermined value PBALSO (e.g. 250 mmHg) (FIG. 3). When the engine engine temperature TW is lower than a predetermined value TWLS (e.g. 70° C.), leaning of the mixture is effected only when the engine is operating in this first region I. In this first region I, the value of the mixture-leaning coefficient KLS is set to the predetermined value XLS1 (e.g. 0.9). When the engine water temperature TW is lower than the above predetermined value TWLS (70° C.), if leaning of the mixture is carried out when the engine is operating in an intermediate or high speed/load region, firing is difficult to take place within the engine cylinders with sparks from the ignition plugs of the engine. Therefore, according to the invention, when the engine temperature is below the predetermined value TWLS, the mixture-leaning region is restricted to the first region I which is a low load region where firing can positively take place even at a low temperature.

The second region II is defined as a region wherein the engine rotational speed Ne is higher than a second predetermined value NLS1 (e.g. 1150 rpm) which is higher than the first predetermined value NLS0 and the intake pipe absolute pressure PBA is lower than a second predetermined value PBALS1 (e.g. 400 mmHg) which is higher than the first predetermined value PBALS0 (FIG. 4). When the vehicle speed V is lower than a predetermined value VLS (e.g. 45 km/h) and the engine water temperature TW is equal to or higher than the aforementioned predetermined value TWLS, leaning of the mixture is carried out in this second region II as well as in the above first region I. Also in this second region, the value of the mixture-leaning coefficient KLS is set to the same value XLS1 as in the first region I. The first predetermined value NLS0 of the engine rotational speed Ne applied in the first region I is set at a value slightly higher than a possible upper limit of the idling speed, which is of the order of 950 rpm. The second predetermined value NLS1 applied in the second region II is set at a value slightly higher than the first predetermined value NSL0, which is of the order of 1150 rpm. The first and second predetermined values PBALS0 and PBALS1 of the intake pipe absolute pressure, respectively, applied in the first region I and the second region II, are set at values which the intake pipe absolute pressure PBA can never assume at sudden acceleration or at wide-open-throttle if the engine rotational speed Ne is higher than the respective first and second predetermined values NLS0, NLS1, for instance, they are set at 250 mmHg and 400 mmHg, respectively. The reason for setting the respective first and second predetermined values of the engine rotational speed Ne and the intake pipe absolute pressure PBA at the above-mentioned values lies in the purpose of preventing degradation of the driveability of the engine due to leaning of the mixture while the engine is being suddenly accelerated from its idling state to start running the vehicle from its standing position. By providing the above-mentioned predetermined values of the engine rotational speed and the intake pipe absolute pressure, the engine operation can shift to a higher speed region without passing the mixture-leaning region when the engine is accelerated from its idling state to start running the vehicle from its standing position, thereby ensuring desired driveability of the engine. Particularly, since the second predetermined value NLS1 of the engine rotational speed Ne is set at a value (1150 rpm) slightly higher than the first predetermined value NLS0 (950 rpm), it can be positively avoided that the engine enters the second region II during the course of acceleration. On the other hand, the predetermined value VLS of the vehicle speed is set at a value corresponding to an upper limit of a usual speed range of a vehicle applied when the vehicle is running in the streets of a city or a town. This is because while running in the streets of a city or a town, the running speed of the vehicle is not so high, and a great number of vehicles are running in the streets and therefore, the amount of emission of nitrogen oxides in the engine exhaust gases should desirably be reduced. Therefore, in an intermediate load region where rather a large amount of nitrogen oxides are emitted from the engine while the vehicle is running in the streets, e.g. a region where the intake pipe absolute pressure exceeds 400 mmHg, leaning of the mixture is not carried out, and instead the air-fuel ratio of the mixture is controlled to a thereotical mixture in a feedback manner responsive to oxygen concentration in the exhaust gases, detected by the $O_2$ sensor in FIG. 1, so as to achieve a maximum conversion efficiency of NOx of the three-way catalyst 14 in FIG. 1.

The third region III is defined as a region wherein the engine rotational speed Ne is higher than a third predetermined value NLS2 (e.g. 1300 rpm) which is higher than the aforementioned second predetermined value NLS1 and the intake pipe absolute pressure PBA is lower than a third predetermined value PBALS2 (e.g. 600 mmHg) which is higher than the aforementioned second predetermined value PBALS1 (FIG. 5). When the vehicle speed is higher than the predetermined value VLS and the engine water temperature TW is higher than the aforementioned predetermined value TWLS, leaning of the mixture is also effected in this third region III as well as in the first and second regions I, II. The vehicle speed can usually exceed the predetermined value VLS when the vehicle is running outside a city or a town where most of vehicles are cruising at high speeds. During running outside a city or a town, it is therefore desirable that leaning of the mixture should be effected to reduce the fuel consumption. In view of this, according to the invention, also in the third region III wherein the intake pipe absolute pressure PBA is higher than the second predetermined value PBALS2 (400 mmHg) and lower than the third predetermined value (600 mmHg) which range is usually assumed by the intake pipe absolute pressure PBA when the vehicle is cruising at a high speed, leaning of the mixture is carried out. In this third region III, the value of the mixture-leaning coefficient KLS is set to the value XLS2 which is different from the value XLS1 applied in the first and second regions I, II. The value XLS2 is set at a value smaller than the value XLS1, e.g. 0.8. This is because in many cases when the engine is operating in this third region III, the vehicle is cruising at a high speed, for instance, outside a city or a town, and therefore the mixture should desirably be leaned to a greater extent than in the other mixture-leaning regions, in order to improve the fuel consumption characteristics of the engine. However, if it is desired to improve the driveability rather than the fuel consumption characteristics while the engine is running in this third region III, the degree of leaning of the mixture may be smaller than in the other mixture-leaning regions, to the contrary. For such purpose, the valve XLS2 is set at a larger value than the value XLS1.

The fourth region IV is defined as a region wherein the engine rotational speed Ne is higher than a fourth predetermined value NZ falling within a high speed range of the engine, e.g. 4000 rpm or higher, and the intake pipe absolute pressure PBA is lower than the aforementioned first predetermined value PBALS0 (FIG. 5). FIG. 5 further shows a fifth region V wherein leaning of the mixture is prohibited, and wherein the engine rotational speed Ne is equal to or higher than the above fourth predetermined value NZ and the intake pipe absolute pressure PBA is higher than the first predetermined value PBALS0. If leaning of the mixture were effected in this fifth region V as well, the exhaust gas temperature would rise enough to cause burning of the catalyst bed of the three-way catalyst. Therefore, when the engine is operating in this region V, leaning of the mixture should not be effected, for the purpose of ensuring satisfactory driveability of the engine and protecting same. On the other hand, when the engine is operating in the aforementioned fourth region IV which is a low load region and usually passed by the engine operation while the engine is being decelerated down from a high speed region, leaning of the mixture is desirable for improvement of the emission characteristics of the engine. In this fourth region IV, the value of the mixture-leaning coefficient KLS is set to the value of XLS1.

As shown in FIGS. 3 through 5, the aforementioned predetermined values NLS0–3 and NZ, and PBALS0–3 of the engine rotational speed and the intake pipe absolute pressure are each provided with a hysteresis margin. That is, each of the predetermined values NLS0–3 and NZ of the engine rotational speed Ne is provided with a hysteresis margin of ±50 rpm and each of the predetermined values PBA0–3 of the intake pipe absolute pressure PBA a hysteresis margin of ±5 mmHg, respectively, between the time when the engine enters the respective mixture-leaning regions and the time when it leaves them. In FIGS. 3 through 5, the lower one of each predetermined value is affixed with a letter L, and the higher one with a letter H, respectively. In the figures, the arrows indicate how to apply such different values to the mixture-leaning regions between entrance of the engine operation into the mixture-leaning regions and departure of same from same. For instance, when the engine enters the first region I, the predetermined value NLS0 of the engine rotational speed is set to 1000 rpm and the predetermined value PBLS0 of the intake pipe absolute pressure to 245 mmHg, respectively, whereas when the engine leaves the first region I, the former is set to 900 rpm and the latter to 255 mmHg, respectively. By providing such hysteresis margins, fine fluctuations in the engine rotational speed Ne or in the intake pipe absolute pressure in the vicinity of the borders between adjacent mixture-leaning regions can be substantially absorbed to thereby ensure stable operation of the engine.

Also, in the illustrated embodiment, the predetermined value TWLS of the engine water temperature TW and the predetermined value VLS of the vehicle speed V are provided with hysteresis margins. For example, the predetermined value TWLS of the engine water temperature TW is provided with a hysteresis margin of ±1° C., and the predetermined value VLS of the vehicle speed V with a hysteresis margin which corresponds to the difference between the turning-on position and turning-off position of a vehicle speed switch used as the vehicle speed sensor 19, which is inherently possessed by the same switch.

Figure 6:
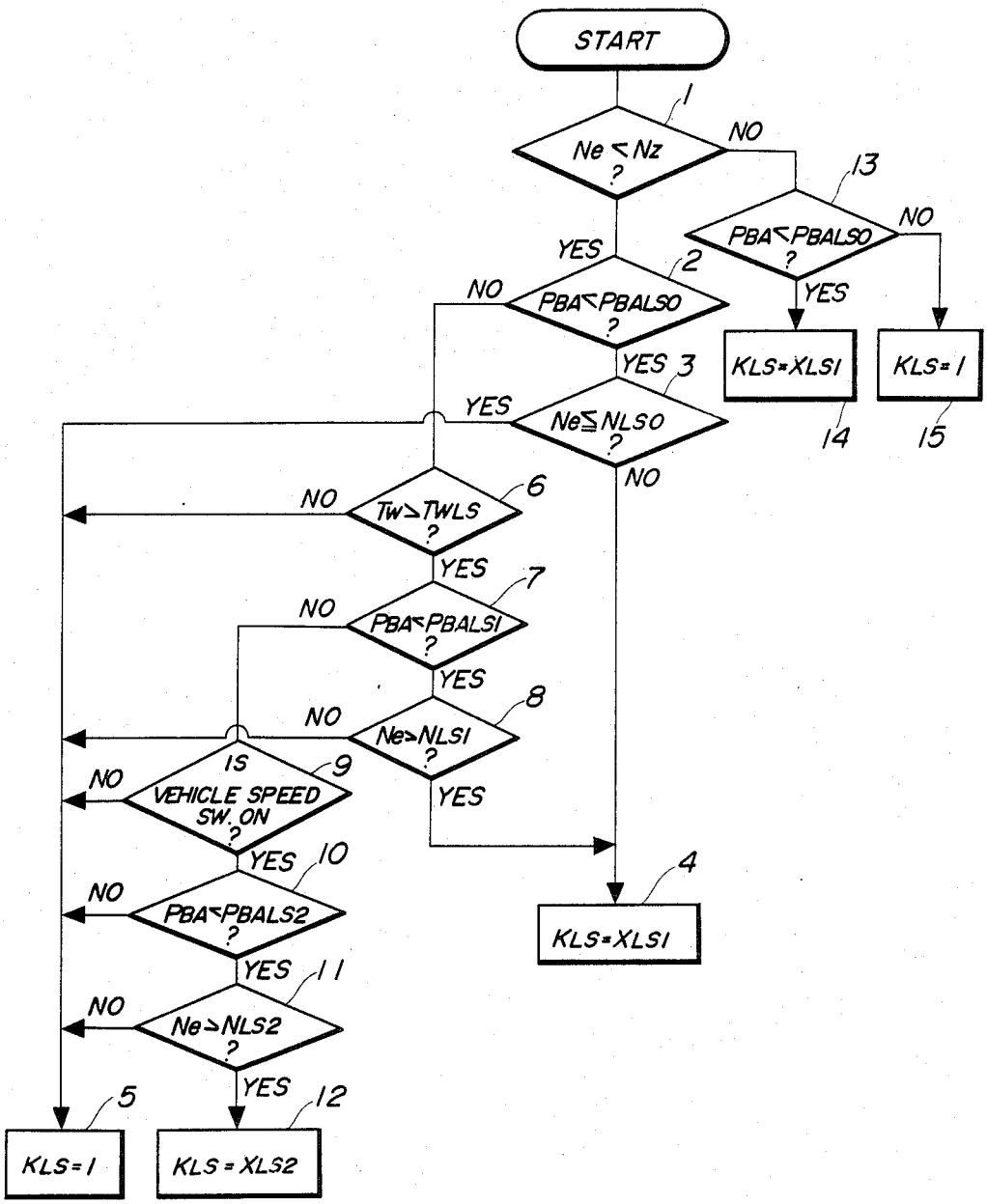
FIG. 6 is a flow chart showing a manner of discriminating mixture-leaning operating regions as well as setting the value of a mixure-leaning coefficient KLS, according to the method of the invention.

FIG. 6 shows a flow chart of a mixture-leaning control subroutine for discriminating the aforementioned mixture-leaning operating regions of the engine and setting the value of the mixture-leaning coefficient KLS. First, it is determined at the step 1 whether or not the engine rotational speed Ne is lower than the predetermined value NZ for discriminating the high speed region of the engine. If the answer is yes, it is then determined at the step 2 whether or not the intake pipe absolute pressure PBA is lower than the first predetermined value PBALS0 for discrimination of the first mixture-leaning region I. If the answer to the question of the step 2 is yes, whether or not the engine rotational speed Ne is lower than the aforementioned first predetermined value NLS0 is determined at the step 3. If the answer is no, that is, if the engine rotational speed Ne is equal to or higher than the first predetermined value NLS0, the engine is deemed to be operating in the first mixture-leaning region I, and therefore the value of the mixture-leaning coefficient KLS is set to the value XLS1 at the step 4. On the other hand, if the answer to the question at the step 3 is yes, that is, if the engine is in an idling region, correction of the valve opening period of the fuel injection valves by means of the correction coefficient KLS is not necessary, and accordingly the value of the coefficient KLS is set to 1 at the step 5. If the answer to the question at the step 2 is no, that is, if the intake pipe absolute pressure PBA is higher than the first predetermined value PBLS0, it is then determined at the step 6 whether or not the engine water temperature TW is equal to or higher than the predetermined value TWLS. If the answer is yes, the engine is deemed not to be operating in any of the predetermined mixture-leaning regions, and accordingly the value of the mixture-leaning coefficient KLS is set to 1 at the step 5. If the answer to the question at the step 6 is yes, a determination is made as to whether or not the engine is operating in the second mixture-leaning region II. That is, the program proceeds to the steps 7 and 8, respectively, to determine whether or not the intake pipe absolute pressure PBA is lower than the second predetermined value PBALS1 and whether or not the engine rotational speed Ne is higher than the second predetermined value NLS1. If both the answers to the questions at the steps 7 and 8 are yes, the program again proceeds to the step 4 to set the value of the mixture-leaning coefficient KLS to the value XLS1. If it is determined at the step 8 that the engine rotational speed Ne is lower than the second predetermined value NLS1, the engine is deemed not to be operating in any of the mixture-leaning regions, and therefore, the value of the coefficient KLS is set to 1 at the step 5. On the other hand, if the answer to the question at the step 7 is no, a determination as to the possibility of the mixture-leaning operation in the third region III is made. That is, the step 9 is executed to determine whether or not the vehicle speed sensor 9 formed by a vehicle speed switch is on or in the closed position. If the answer is no, that is, if the vehicle speed V is equal to or lower than the predetermined value VLS (45 km/h), the value of the coefficient KLS is set to 1 at the step 5. If the answer is yes, the steps 10 and 11 are executed, wherein determinations are made, respectively, as to whether or not the intake pipe absolute pressure PBA is lower than the third predetermined value PBALS2 and whether or not the engine rotational speed Ne is higher than the third predetermined value NLS2. If both of the answers to the questions at the steps 10 and 11 are yes, the value of the coefficient KLS is set to the value XLS2 to effect leaning of the mixture in the third mixture-leaning region III, at the step 12. If neither of the answers to the questions at the steps 10 and 11 is yes, the value of the coefficient KLS is set to 1 at the step 5.

On the other hand, when the answer to the question at the step 1 is no, that is, when the engine rotational speed Ne is determined to be higher than the predetermined value NZ, it is then determined at the step 13 whether or not the intake pipe absolute pressure PBA is lower than the first predetermiend value PBALS0. If the answer is yes, the engine is deemed to be operating in the fourth mixture-leaning region IV, and accordingly the value of the coefficient KLS is set to the value XLS1 at the step 14, whereas if the answer is no, the engine is deemed to be operating in the aforementioned fifth region V in FIG. 5, the value of the coefficient KLS is set to 1 at the step 15 to prohibit the mixture-leaning operation.

In the above stated steps for comparing actual values of the engine rotational speed Ne and the intake pipe absolute pressure PBA with respective predetermined values, actually such comparisons are made of the actual Ne and PBA values with different values of each of the predetermined values between entrance of the engine operation into the mixture-leaning regions and departure of same therefrom, due to the aforementioned hysteresis margins. But, in the foregoing description, comparisons with basic values alone are given for simplification of the explanation.

Although in the foregoing embodiment the first to third mixture-leaning regions I–III are defined by different predetermined values of both of the intake pipe absolute pressure PBA and the engine rotational speed Ne, these regions may be defined by different predetermined values of one of the two parameters and a single predetermined value of the other parameter, depending upon the operating characteristics of the engine.

What is claimed is:

1. A method for electronically controlling the air-fuel ratio of an air-fuel mixture being supplied to an internal combustion engine for use in a vehicle, in response to operating conditions of said engine, the method comprising the steps of: (1) setting beforehand a plurality of different operating regions of said engine, each defined by predetermined values of first and second parameters indicative of operating conditions of said engine; (2) detecting values of said first and second parameters; (3) detecting the speed of said vehicle; (4) comparing a value of the speed of said vehicle detected in said step (3) with a predetermined value, (5) selecting from said plurality of different operating regions first and second predetermined mixture-leaning regions wherein leaning of said mixture is required to control the air-fuel ratio of said mixture to a value leaner than a theoretical mixture ratio, respectively, when said detected value of said speed of said vehicle is lower than said predetermined value and higher than same, the total range of said first predetermined mixture-leaning region being smaller than that of said second predetermined mixture-leaning region; (6) determining whether or not said engine is operating in one of said first and second predetermined mixture-leaning regions selected in said step (5), from values of said first and second parameters detected in said step (2); and (7) effecting leaning of said mixture when it is determined in said step (6) that said engine is operating in said selected one operating region.

2. A method as claimed in claim 1, wherein said second predetermined mixture-leaning region comprises a particular mixture-leaning region which is selected only when said detected value of the speed of said vehicle is higher than said predetermined value, and at least one other mixture-leaning region which is selected also when said detected value of the speed of said vehicle is lower than said predetermined value, said leaning of said mixture during operation of said engine in said particular mixture-leaning region of said second mixture-leaning region being effected to an extent different from one effected during operation of said engine in said at least one other mixture-leaning region of said second predetermined mixture-leaning region.

3. A method as claimed in claim 1, wherein said predetermined value of the speed of said vehicle is set to different values between the time when the speed of said vehicle is increasing and the time when it is decreasing.

4. A method as claimed in claim 1, wherein said predetermined values of said first and second parameters defining each one of said plurality of different operating regions of said engine are each set to different values between the time when said engine enters said each one of said plurality of different operating regions of said engine and the time when the former leaves the latter.

5. A method as claimed in any of claims 1, 3–5, further including the steps of: (8) detecting the temperature of said engine; (9) comparing a value of the temperature of said engine detected in said step (8) with a predetermined value; (10) selecting part of said different operating regions of said engine as at least one mixture-leaning region wherein leaning of said mixture is required to control the air-fuel ratio of said mixture to a value leaner than a theoretical mixture ratio, when said detected value of the temperature of said engine is lower than said predetermined value; (11) determining whether or not said engine is operating in said at least one mixture-leaning region selected in said step (10), from values of said first and second parameters detected in said step (2); and (12) effecting leaning of said mixture when it is determined in said step (11) that said engine is operating in said at least one mixture-leaning region selected in said step (10).

6. A method as claimed in claim 5, wherein said at least one mixture-leaning region includes a low load region of said engine wherein firing can positively take place within cylinders of said engine even when the temperature of said engine is lower than said predetermined value.

7. A method as claimed in claim 1, wherein said engine includes an intake passage, said first parameter being the rotational speed of said engine, and said second parameter being absolute pressure in said intake passage.

8. A method as claimed in claim 7, further including the steps of: (8) comparing a value of the rotational speed of said engine as said first parameter detected in said step (2) with a predetermined value; (9) selecting part of said plurality of different operating regions of said engine as at least one mixture-leaning region wherein leaning of said mixture is required to control the air-fuel ratio of said mixture to a value leaner than a theoretical mixture ratio, when it is determined in said step (8) that said detected value of the rotational speed of said engine is higher than said predetermined value; (10) determining whether or not said engine is operating in said at least one mixture-leaning region selected in said step (9), from values of the rotational speed of said engine and the absolute pressure in said intake passage detected in said step (2); and (11) effecting leaning of said mixture, when it is determined in said step (10) that said engine is operating in said at least one mixture-leaning region selected in said step (9).

9. A method as claimed in claim 7, wherein said plurality of different operating regions of said engine include a first subdivided region I wherein the rotational speed of said engine is higher than a first predetermined value and the absolute pressure in said intake passage is lower than a first predetermined value, a second subdivided region II wherein the rotational speed of said engine is higher than a second predetermined value which is higher than said first predetermined value and the absolute pressure in said intake passage is lower than a second predetermined value which is higher than said first predetermined value, said second subdivided region II being exclusive of said first subdivided region I, and a third subdivided region III wherein the rotational speed of said engine is higher than a third predetermined value which is higher than said second predetermined value and the absolute pressure in said intake passage is lower than a third predetermined value which is higher than said second predetermined value, said third subdivided region III being exclusive of said first I and second II subdivided regions, said step (5) including selecting all said first I, second II and third III subdivided regions as said second predetermined mixture-leaning region when a value of the speed of said vehicle detected in said step (3) is higher than said predetermined value, and selecting said first I and second II subdivided regions alone as said first predetermined mixture-leaning region when said detected value of the speed of said vehicle is lower than said predetermined value.

10. A method as claimed in claim 8, wherein said plurality of different operating regions further includes a fourth subdivided region IV wherein the rotational speed of said engine is higher than a fourth predetermined value which is higher than said third predetermined value and the absolute pressure in said intake passage is lower than said first predetermined value, the method further including the steps of (8) determining whether or not said engine is operating in said fourth subdivided region IV, from value of the rotational speed of said engine and the absolute pressure in said intake passage detected in said step (2), and (9) effecting said leaning of said mixture when it is determined in said step (8) that said engine is operating in said fourth subdivided region IV.

11. A method as claimed in claim 8, further including the steps of: (8) detecting the temperature of said engine; (9) selecting said first subdivided region I alone as a mixture-leaning region wherein leaning of said mixture is required to control the air-fuel ratio of said mixture to a value leaner than a theoretical mixture ratio, when a value of the temperature of said engine detected in said step (8) is lower than a predetermined value; (10) determining whether or not said engine is operating in said first subdivided region I, from values of the rotational speed of said engine and the absolute pressure in said intake passage detected in said step (2); and (11) effecting said leaning of said mixture, when it is determined in said step (10) that said engine is operating in said first subdivided region I.

12. A method as claimed in claim 11, wherein said first region is a low load region of said engine wherein firing can positively take place within cylinders of said engine even when the temperature of said engine is lower than said predetermined value.

* * * * *

UNITED STATES PATENT AND TRADEMARK OFFICE

CERTIFICATE OF CORRECTION

PATENT NO. : 4,526,153

DATED : July 2, 1985

INVENTOR(S) : Shumpei Hasegawa; Osamu Gotoh; and Yutaka Otobe

It is certified that error appears in the above-identified patent and that said Letters Patent is hereby corrected as shown below:

In claim 5, column 12, line 27, delete "1, 3, 5" and insert --1-4--;

In claim 10, column 14, line 1, delete "8" and insert --9--.

Signed and Sealed this

*Eighteenth* Day of *March 1986*

[SEAL]

*Attest:*

DONALD J. QUIGG

*Attesting Officer*

*Commissioner of Patents and Trademarks*